United States Patent [19]

Schaffner, Jr.

[11] Patent Number: 4,603,607

[45] Date of Patent: Aug. 5, 1986

[54] PIVOT CONNECTION FOR SLIP JOINT PLIERS

[75] Inventor: Bernard P. Schaffner, Jr., Meadville, Pa.

[73] Assignee: Channellock, Inc., Meadville, Pa.

[21] Appl. No.: 352,338

[22] Filed: Feb. 25, 1982

[51] Int. Cl.[4] ..... B25B 7/04

[52] U.S. Cl. ..... 81/414; 81/416

[58] Field of Search ..... 81/416, 414

[56] References Cited

U.S. PATENT DOCUMENTS

| | | | |
|---|---|---|---|
| 1,162,141 | 11/1915 | De Arment | 81/416 |
| 1,428,357 | 9/1922 | Bullard | 81/416 |
| 2,674,143 | 4/1954 | Peterson | 81/416 |
| 3,091,841 | 6/1963 | Wurzel | 81/416 |
| 4,271,732 | 6/1981 | Vaughan | 81/414 |

FOREIGN PATENT DOCUMENTS

| | | | |
|---|---|---|---|
| 666075 | 2/1952 | United Kingdom | 81/416 |

*Primary Examiner*—Frederick R. Schmidt
*Assistant Examiner*—J. T. Zatarga
*Attorney, Agent, or Firm*—Lackenbach Siegel Marzullo Presta & Aronson

[57] ABSTRACT

A pivot connection for slip joint pliers in which a rivet has a shank with a preformed head at one end overlapping one of the plier halves to be connected, and the other end of the shank is headed over the other plier half and expanded into a hole in the other plier half tapered outwardly at a locking taper angle.

5 Claims, 6 Drawing Figures

PIVOT CONNECTION FOR SLIP JOINT PLIERS

This invention is intended to provide a pivot connection for slip joint pliers which is stronger than the nut and bolt connection now in use.

Figure 1:
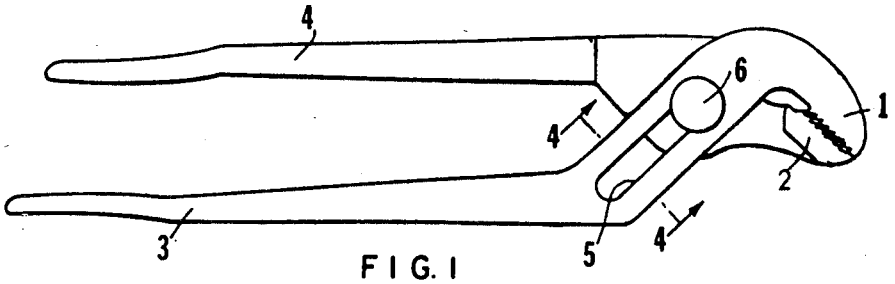
Figure 4:
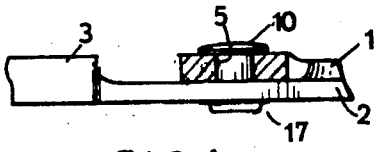
Figure 2:
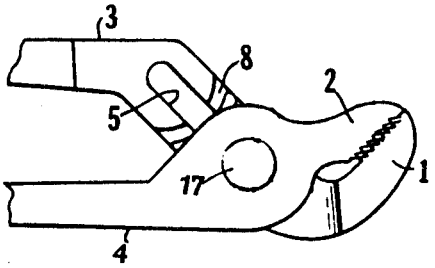
Figure 3:
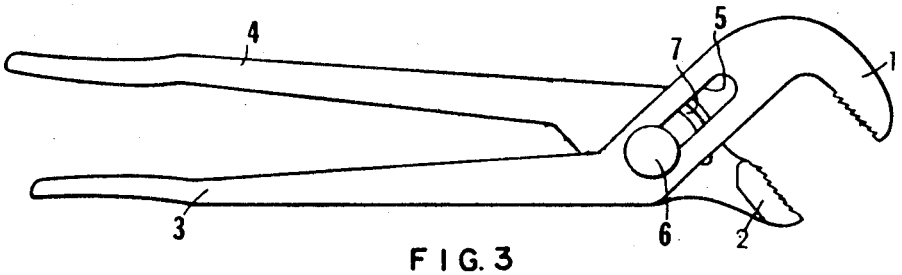
Figure 5:
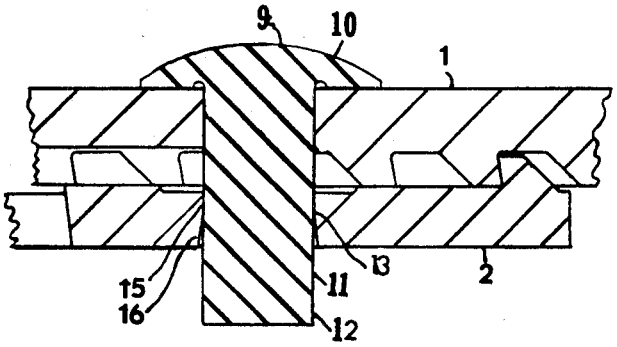
Figure 6:
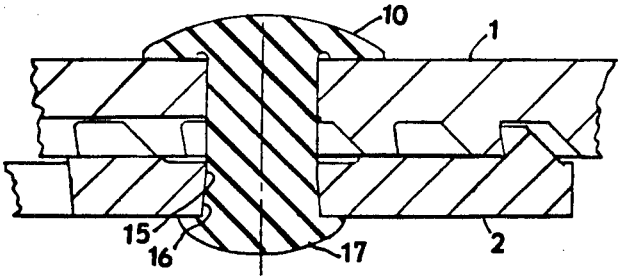

In the drawing, FIG. 1 is a top plan view of a slip joints pliers with the jaws in the fully closed position, FIG. 2 is a bottom plan view of the FIG. 1 pliers, FIG. 3 is a top plan view of the FIG. 1 pliers with the jaws in the maximum open position, FIG. 4 is a section on line 4—4 of FIG. 1, FIG. 5 is an enlarged section through the pivot connection before the rivet is headed, and FIG. 6 is a similar enlarged section after the rivet is headed.

The invention is applied to slip joint pliers, so-called because the plier jaws may be moved to several positions to vary the width of the grip of the jaws. In the particular pliers illustrated, which are of the tongue and groove type shown in U.S. Pat. Nos. 2,640,381 and 2,582,527, there are jaws 1 and 2 respectively carried by handles 3 and 4. The jaw 1 has an elongated slot 5 for a pivot 6. Successive pivot positions are established by moving the pivot 6 along the slot 5. In each position, a rib 7 on the jaw 2 is received in a groove 8 in the jaw 1. The radius of curvature of the rib 7 and the grooves 8 is the same, and each is centered on the pivot pin 6, so that in each position the jaws may be pivoted to open and close the grip. This and other types of slip joint pliers are well known in the art, and need not be further illustrated.

Heretofore the pivot 6 for the slip joint pliers has been a nut and bolt. Under some stress conditions, the nut and bolt connection breaks.

The slip joint requires loosely fitting parallel parts which pivot freely in each pivot position and which slide freely from one pivot position to another. The requirement of sliding is not present in nonslip-joint or solid joint pliers where there is only a single pivot. For the solid joint pliers rivets have been obvious and common for many years. For the slip joint pliers only nut and bolt connections have been "obvious." The nut and bolt connections can be adjusted to provide free sliding but are subject to breakage under stress.

To increase the strength of the pivot connection, there is substituted for the nut and bolt a rivet 9 having a head 10 corresponding to the head of the bolt it replaces, and a shank 11 the same size as the shank of the bolt. The head 10 of the rivet overlaps the outer surface of the slot 5 in the same manner as the head of the bolt, and the shank 11 of the rivet slides in the slot 5 as freely as the shank of the bolt it replaces. The end 12 of the rivet projects through a hole 13 in the jaw 2 and beyond the outer surface of the jaw 2. The end of the hole 13 adjacent the jaw 1 is cylindrical, as indicated by the numeral 15. The outer part of the hole 13 is tapered as indicated by the numeral 16, the angle of taper being a locking taper. When the projecting end 12 of the rivet is headed over the jaw 2 as indicated at 17, the shank 11 is expanded into the tapered section 16 of the hole 13 and is also expanded into tight engagement with the cylindrical section 15 of the hole 13. This results in the shank 11 of the rivet being nonrotatably united with the jaw 2.

During riveting, the head 10 of the rivet is supported by a surface (not shown) which is spaced a small distance e.g., 0.004") lower than the surface which supports the jaw 1. During riveting, the riveting force clamps the jaw 2 tightly against the jaw 1. The clearance provided by the support for the head 10 of the rivet provides sufficient freedom so that the shank 11 can slide back and forth along the slot 5 when the handles 3 and 4 are rotated to a position in which the tongue 7 and grooves 8 are disengaged. As soon as the tongue 7 reaches the desired position along the slot, the handles are rotated in the jaw closing direction, bringing the tongue 7 into engagement with the selected groove 8.

The strength of the riveted connection is 20–30% greater than the strength of the nut and bolt connection it replaces. Because of this increase in strength, the riveted connection never breaks. The strength is greater than the pliers.

I claim:

1. An improved high strength slip joint pliers comprising:

first and second members each having a handle portion connected to shanks extending from mating jaws;

the shank of the jaw of said first member having a slot with a plurality of pivot positions along its length defined by grooves;

said shank of the second member having a circular hole with a cylindrical section on one side surface thereof adjacent said shank of the first member with a circular tapered part facing outwardly from said cylindrical section to an opposite side surface of said shank of the second member, with an angle of taper of said tapered part being a locking taper; and a rib like tongue extending outwardly from said one side surface of said shank of said second member and being adapted to be positioned in any selected one of said pivot positions for adjusting the opening between said mating jaws; and a permanently set, sliding pivot type fastener connection between the shanks of said mating jaws embodying a rivet with a head and shank;

said head overlapping said slot and a portion of the shank extending through the slot and slidable back and forth along the slot;

the remaining portion of said shank extending through the cylindrical section of said circular hole and through said circular tapered part and projecting beyond the shank of said second member; the end of said remaining portion which projects beyond said shank of the second member being headed over the second member forming in one step a round overlapping head like said rivet head and expanded tightly into said circular tapered part and at the same time being expanded into tight engagement around the intersection of said circular tapered part with the outer surface of said second member underlying said overlapping head and further expanded into tight engagement with said cylindrical section of said circular hole and thereby forming a united, permanently set, non-rotatable joint of the shank of said rivet with the shank of said second member, and sliding pivot fastener connection with a spaced clearance of predetermined size between the head of said rivet and said side surface from which said rib extends, thereby enabling said shank of said rivet to be freely slidable back and forth along said slot when said handles of said pliers are rotated to a position in which said rib like tongue and said grooves are disengaged.

2. The improved high strength slip joint pliers according to claim 1, wherein said grooves are curved, and said rib like tongue and grooves have like radii of curvatures so as to interfit in said plurality of pivot positions in a manner which permits said jaws to freely pivot from a closed to an open position and vice versa.

3. The improved high strength slip joint pliers according to claim 1, wherein the strength of said permanently set non-rotatable joint and sliding pivot fastener connection exceeds the strength of said pliers.

4. The improved high strength slip joint pliers according to claim 1, wherein said spaced clearance of predetermined size is of the order of about 0.004 inch.

5. The improved high strength slip joint pliers according to claim 1, wherein the mass of said round overlapping head formed over said second member being substantially greater than the mass of the tapered portion extending outwardly into said circular tapered part from the cylindrical section of said circular hole.

* * * * *